United States Patent [19]

Maroné et al.

[11] Patent Number: 5,070,796

[45] Date of Patent: Dec. 10, 1991

[54] FOLDING TABLE

[75] Inventors: Francis Maroné; Xavier Bourdery, both of Neuville-les-Dieppe, France

[73] Assignee: S.A. Vinco M.T., Neuville-les-Dieppe, France

[21] Appl. No.: 564,427

[22] Filed: Aug. 8, 1990

[30] Foreign Application Priority Data

Aug. 8, 1989 [FR] France ..... 89 10645

[51] Int. Cl.[5] ..... A47B 3/00

[52] U.S. Cl. ..... 108/124; 108/130; 248/188.6

[58] Field of Search ..... 108/123, 124, 130, 131, 108/126; 248/188.1, 188.6

[56] References Cited

U.S. PATENT DOCUMENTS 2,666,673 1/1964 Hughes ..... 108/157

3,695,567 10/1972 Weagle ..... 248/188.6

FOREIGN PATENT DOCUMENTS 2267721 12/1975 France ..... 108/130

*Primary Examiner*—Kenneth J. Dorner

*Assistant Examiner*—Gerald A. Anderson

[57] ABSTRACT

A folding table of the type comprising a table top, two leg assemblies pivotally mounted to one of the faces of the table top, and fixing means for fixing the leg assemblies to the table top when the table is in the erected position. Each leg assembly comprises two legs interconnected firstly by a first link element which supports a portion of the fixing means with the other portion thereof being supported by the table top, and secondly by a second link element which is pivotally hinged to the table top.

1 Claim, 2 Drawing Sheets

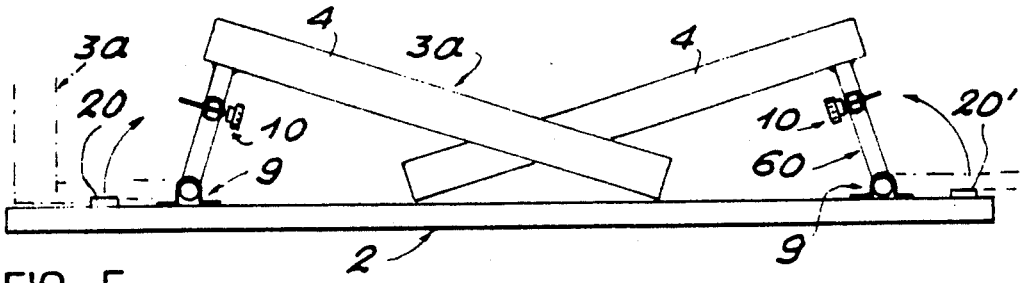
FIG. 5
FIG. 6
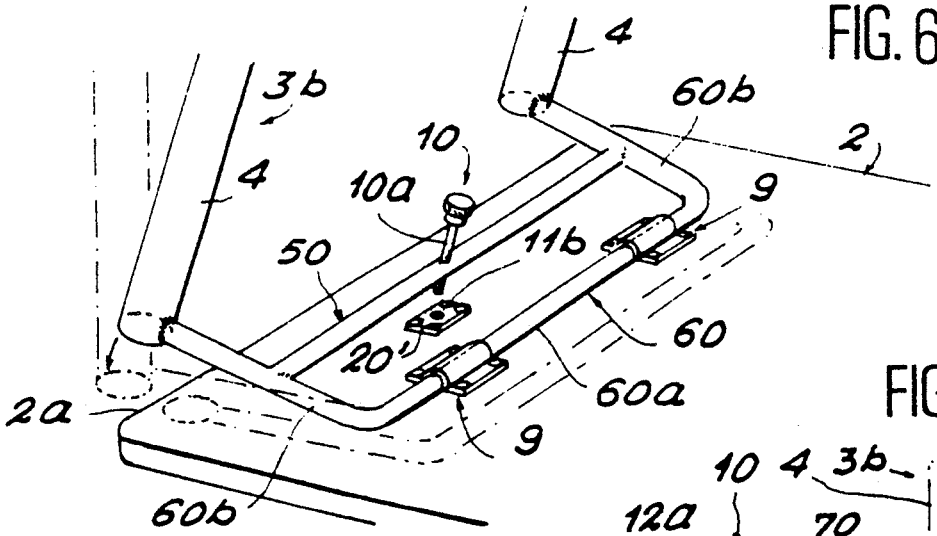
FIG. 8
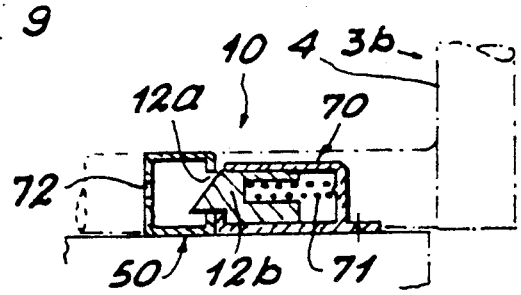
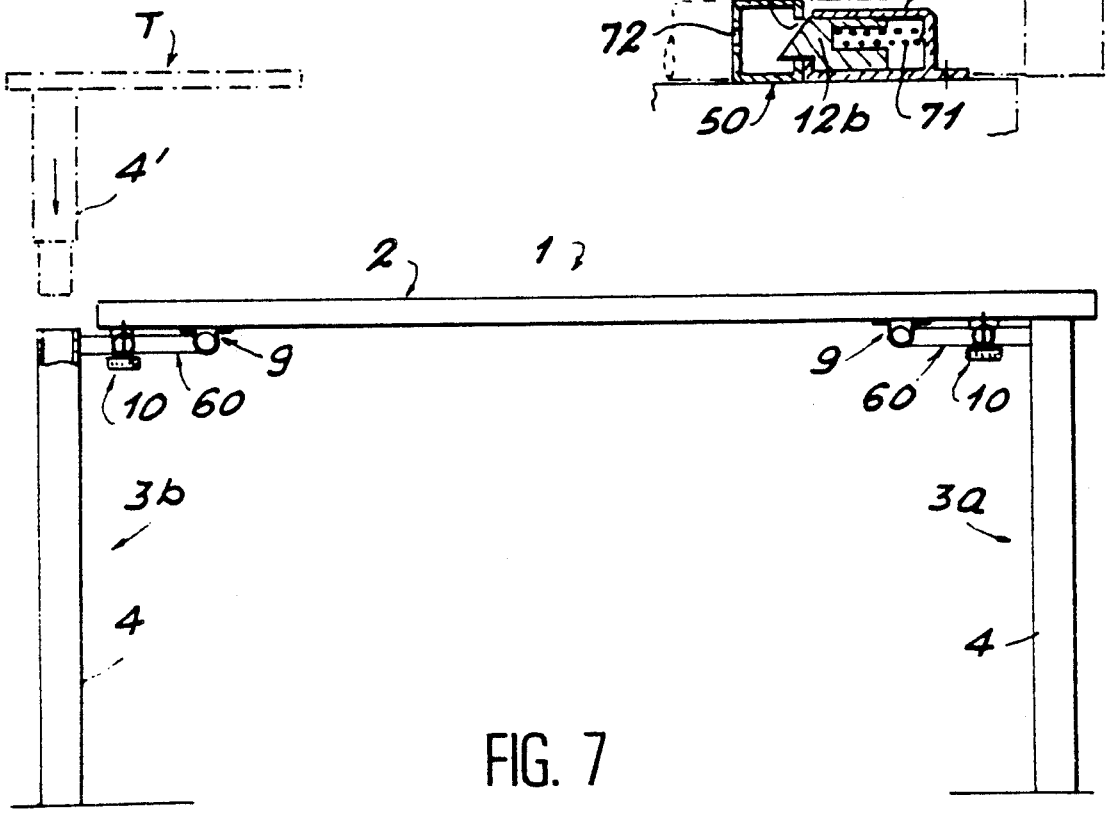
FIG. 7

FOLDING TABLE

The present invention relates to a folding table of the type comprising a table top, two leg assemblies pivotally mounted to one of the faces of the table top, and fixing means for fixing the leg assemblies to the table top when the table is in the erected position.

BACKGROUND OF THE INVENTION

In general, there are numerous types of folding table having various different structures for the hinge system between the leg assemblies and the table top depending, in particular, on the form of the leg assemblies, and having various different structures for the fixing means depending, in particular, on the size of the table, with account also being taken of the materials used, of the intended purpose of the table, and of economic factors in order to reach an acceptable quality/price ratio.

The stability and the rigidity of such tables are usually rather poor, i.e. they are not suitable for supporting heavy loads.

An object of the invention is to provide a folding table structure of entirely novel design suitable, in particular, for mitigating the above-mentioned drawbacks while nevertheless being easy to erect and requiring component parts that are simple and small in number, in particular with respect to the hinges and the fixing means between the leg assemblies and the table top.

SUMMARY OF THE INVENTION

To this end, the present invention provides a table of the above-specified type in which each leg assembly comprises two legs interconnected firstly by a first link element which supports a portion of the fixing means with the other portion thereof being supported by the table top, and secondly by a second link element which is pivotally hinged to the table top.

In another disposition of the invention, the fixing means associated with each leg assembly comprise a single device constituted, for example, by a threaded rod supported by the first link element and by a tapped hole provided in the table top or in an intermediate component fixed to the table top, with the threaded rod being screwed therein to fix together the leg assembly and the table top.

In a particular embodiment of the invention, the two legs of at least one of the leg assemblies are outside the table top when the table is in the erected position.

In another disposition of the invention, the two legs of a leg assembly which are thus outside the table top when the table is in the erected position are constituted by hollow tubes suitable for receiving the end of a support leg for an auxiliary equipment such as a shelf.

BRIEF DESCRIPTION OF THE DRAWINGS

Embodiments of the invention are described by way of example with reference to the accompanying drawings, in which:

FIG. 5 is a side view showing a second embodiment of a table of the invention in the folded position;

FIG. 6 is a fragmentary perspective view showing the various component parts of the second embodiment of the table;

FIG. 7 is a side view of the second embodiment table shown together with an auxiliary equipment; and FIG. 8 is a diagram showing snap-fastening leg fixing means suitable for use in either of the above embodiments as a replacement for one of the threaded rods.

MORE DETAILED DESCRIPTION

Figure 1:
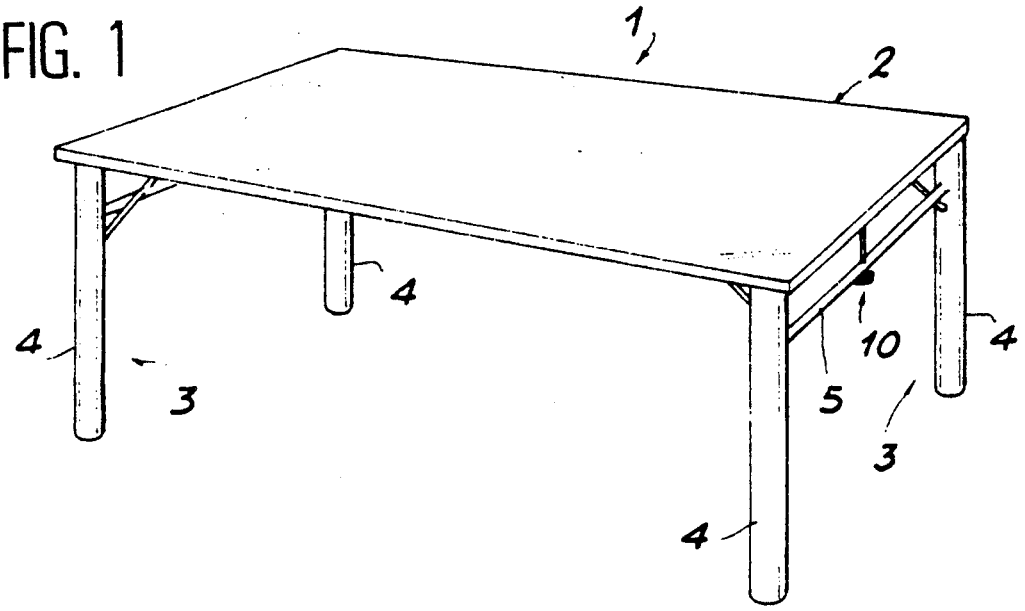
FIG. 1 is a perspective view of a first embodiment of a table of the invention in the erected position.

A table 1 of the invention comprises a table top 2 and two leg assemblies 3 hinged to the bottom face of the table top 2.

In a first embodiment shown in FIGS. 1 to 4, each leg assembly 3 comprises two legs 4 such as two parallel tubular elements interconnected at one end by a first link element such as a rigid cross bar 5 and projecting freely at the other end. Each leg assembly 3 is hinged to pivot relative to the table top 2 by means of a second link element such as a tie bar 6 connected to the two legs 4. More precisely, the tie bar 6 is in the form of a U-shaped metal rod with limited ability to deform elastically, the U-shape comprising a central portion **6*a* and two side portions or arms 6*b* whose free ends are outwardly directed at substantially 90° in order to form linking pegs 6*c***.

The tie bar 6 is not rigidly fixed to the legs 4. After its side portions **6*b* have been moved towards each other by elastic deformation and then released, the linking pegs 6*c* are positively engaged in corresponding facing holes provided in the legs 4 while still leaving the legs free to pivot relative to the axis formed by the two axially aligned pegs 6*c*. The central portion 6*a* of the tie bar 6 bears against the bottom face of the table top 6, extending parallel to the bar 5 and held in place by two hinge plates 9, thereby pivotally connecting each leg assembly 3 to the table top 2**.

Figure 3:
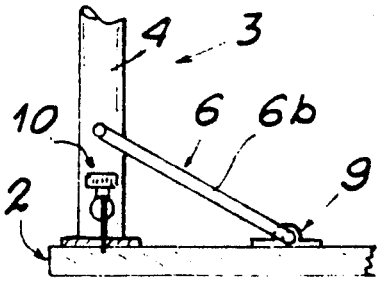
FIG. 3 is a fragmentary diagrammatic view showing a leg assembly fixed to the table top.
Figure 4:
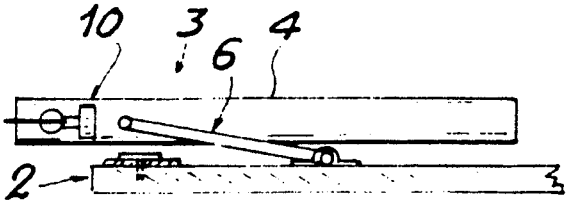
FIG. 4 is a fragmentary diagrammatic view showing a leg assembly in the folded down position against the table top.

Thus, since the two legs 4 are free to pivot about the linking pegs **6*c* and since the tie bar 6 is free to pivot by virtue of the hinge plate 9, these two hinges enable the legs 4 to take up either a position at 90° relative to the table top 2 (unfolded position shown in FIG. 3), or else a position where they are substantially parallel to the table top 2 (folded down position shown in FIG. 4**).

As can be seen in FIGS. 3 and 4, it is important to observe in this first embodiment that the hinge plates 9 are fixed to the bottom face of the table top 2 in a position such that the distance between the central portion **6*a* of the tie bar 6 and the adjacent side 2*a* of the table top 2 which is parallel to said central portion 6*a* is greater than the length of the arms 6*b* of the tie bar 6, so that the top ends of the legs 4 come into contact with the table top 2 when the table is in the erected position and prior to being held in this position by fixing means 10**, described below.

The fixing means between each leg assembly 3 and the table top 2 is constituted by a respective single device 10 which in the example shown is a threaded rod **11*a* terminated at one end by a control knob b, and by a tapped hole 11*b* for receiving the threaded rod 11*a*. The rod 11*a* is mounted through the bar 5, substantially in the middle thereof, and the tapped hole 11*b* is provided in the bottom face of the table top 2. Naturally, the length of the threaded rod 11***a* is greater than the distance between the bar 5 and the table top 2 when the corresponding leg assembly 3 is in its extended position.

Figure 2:
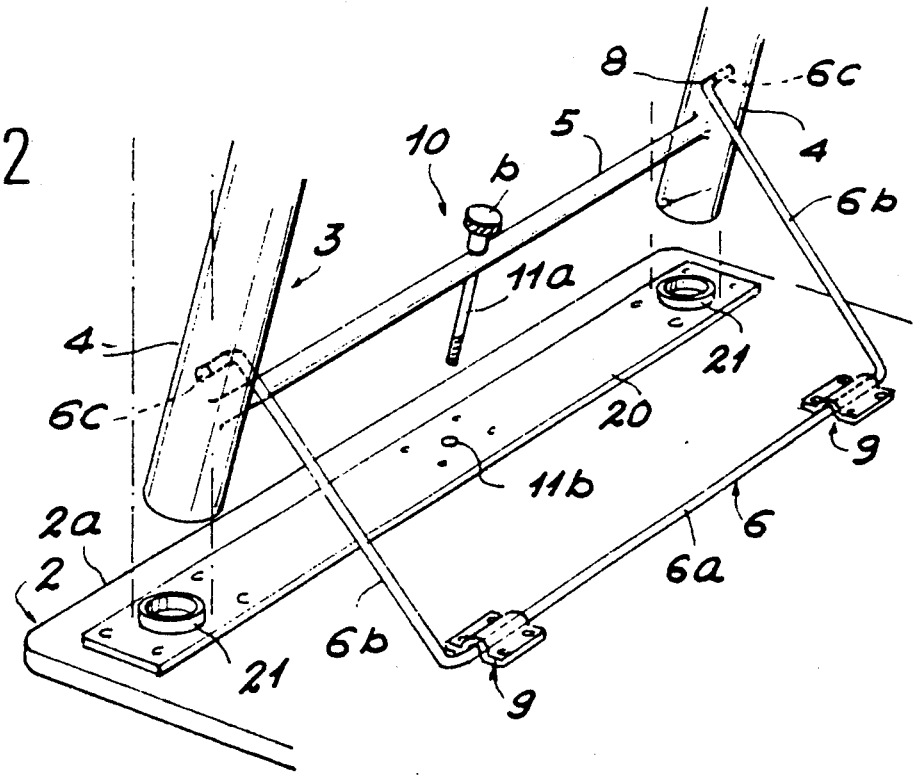
FIG. 2 is a fragmentary perspective view showing the various component parts of the table shown in FIG. 1.

Preferably, two plates 20 are fixed to the bottom face of the table top 2 in order to serve as an interface between the table top 2 and respective ones of the leg assemblies 3. In this case, each hole 11 as shown in FIG. 2 is formed in the thickness of the associated plate 20. Each plate 20 has two projecting cylindrical portions 21 of slightly smaller diameter than the legs 4 disposed facing respective ones of the two legs 4 of the associated leg assembly 3 so as to engage therein and impart better stability to the table 1 when it is in the erected position.

In a second embodiment shown in FIGS. 5 to 7, each leg assembly 3*a*, 3*b* is constituted by two legs 4 such as two parallel tubes which are interconnected at one end by a first link element such as a rigid cross bar 50, and whose other ends (the bottom ends when the table is erected) project freely. Each leg assembly 3*a*, 3*b* is pivotally mounted to the table top by means of a second link element such as a U-shaped bar 60, with the free ends of the two side portions or arms 6*b* of each bar 60 being connected to the legs 4 in such a manner that the bars 50, 60 come into contact with the table top 2 when the table 1 is in the erected position.

The central portion 60*a* of the bar 60 bearing against the bottom face of the table top 2 is held in place by two hinge plates 9 enabling the associated leg assembly 3*a*, 3*b* to pivot relative to the table top 2.

In this second embodiment, the hinge plates 9 associated with leg assembly 3*a* (FIGS. 5 and 7) are fixed to the bottom face of the table top 2 in such a position that the distance between the central portion 60*a* of the bar 60 and the adjacent side 2*a* of the table top 2 parallel to said central portion 60*a* is greater than the length of the side portions 60*b* of the bar 60 such that the top ends of the legs 4 make contact with the table top 2 when the table is in the erected position.

With reference now to leg assembly 3*b* (FIGS. 5 and 6), the hinge plates 9 are fixed on the bottom face of the table top 2 in a position such that the side portions 60*b* of the bar 60 are longer than the distance between the hinge plates 9 and the adjacent side 2*a* of the table top 2 parallel to the central portion 60*a* of the bar 60, and such that the distance between said central portion 60*a* and the cross bar 50 is less than the above-mentioned distance. Under these conditions, when the leg assembly 3*b* is extended, the legs 4 lie outside the table top 2 while the bars 50 and 60 are in contact with the table top 2 in order to ensure that the table 1 is stable and rigid.

As for the first embodiment, the fixing means 10 for each leg assembly are constituted by a single device 10 such as a threaded rod 10*a* having a rotary control knob 10*b*, said device being supported by the bar 50 and co-operating with a tapped hole 11*b* provided in the bottom face of the table top 2 or in an intermediate plate 20' fixed to the table top 2.

As shown diagrammatically in FIG. 7, this external position for the leg assembly 3*b* relative to the table top 2 makes it possible to associate auxiliary equipment with the table, e.g. a shelf T which may be supported, for example, by a tubular leg 4' capable of being partially received in one of the legs 4 of the leg assembly 3*b*. When the shelf is used as a desk, the shelf T may serve to support a telephone, for example.

The fixing device 10 used in both embodiments described above may be replaced by any equivalent device such as that shown in FIG. 8.

In this case, each fixing device 10 is of the automatic snap-fastening type having a resiliently retractable latch bolt 12*b* which co-operates with an orifice 12*a*. In the example shown, part of the bolt 12*b* projects from a box 70 fixed to the bottom face of the table top 2. The box 70 contains a spring 71 which enables the bolt 12*b* to be retracted inside the box 70. The orifice 12*a* is provided in the first link element 5, 50 of each leg assembly 3, 3*a*, or 3*b*.

When the table is being put up, the link element 5, 50 of each leg assembly 3 makes contact with the associated bolt 12*b* towards the end of the folding out movement of the leg assembly, thereby temporarily causing the bolt to be pushed back inside the box 70. As soon as the orifice 12*a* in the link element 5, 50 comes level with the bolt 12*b*, the bolt is urged back out from the box 70 to engage inside the orifice 12*a*, thereby fixing the leg assembly 3 to the table top 2. In order to fold down the leg assembly 3, it suffices merely to provide an orifice 72 in the link element 5, 50 facing the orifice 12*a* so as to enable the bolt 12*b* to be disengaged by means of an elongate tool engaged in the orifice 72.

Naturally, the two above-described embodiments of the invention are not limiting and equivalent dispositions will easily occur to the person skilled in the art without going beyond the scope of the invention. In particular, each fixing element 10 associated with each leg assembly 3, 3*a*, 3*b* may also be constituted merely by a screw.

We claim:

1. A folding table of a type comprising: a table top having two faces, two leg assemblies pivotally mounted to one of the faces of the table top, and fixing means for fixing the leg assemblies to the table top when the table is unfolded, wherein each leg assembly comprises two legs interconnected firstly by a first link element which supports a first portion of the fixing means with the second portion of said fixing means being supported by the table top and secondly by a second link element which is pivotally hinged to the table top, a fixing device associated with each leg assembly which comprises a threaded rod supported by the first link element and screwed into a tapped hole of the table top in order to fix the corresponding leg assembly to the table top, the first link element is constituted by a rigid bar, the second link element is constituted by a U-shaped tie bar having its central portion pivotally hinged to the table top by means of hinge plates.

said tie bar including side portions which are elastically deformable and having their free ends bent through substantially 90° in order to constitute link pegs which are engaged in respective facing holes provided in each of the legs of each leg assembly, the side portions of the tie bar are shorter than the distance between the hinge plates and the adjacent side of the table top parallel to the central portion of the tie bar, and the tapped hole is machined in an intermediate plate which is fixed to the table top, said plate having a cylindrical portion at each end for engaging in the end of the corresponding leg, said legs being tubular in shape and top ends of said legs being open for receiving said cylindrical portions.

* * * * *